US006102794A

United States Patent [19]

Cline

[11] Patent Number: 6,102,794

[45] Date of Patent: Aug. 15, 2000

[54] ROOF VENT

[76] Inventor: Roger M. Cline, P.O. Box 126, Bluemont, Va. 22012

[21] Appl. No.: 09/315,959

[22] Filed: May 21, 1999

[51] Int. Cl.[7] ..... F24F 13/20

[52] U.S. Cl. ..... 454/368; 52/199

[58] Field of Search ..... 454/1, 3, 368, 454/367; 52/199; 285/42

[56] References Cited

U.S. PATENT DOCUMENTS

| | | |
|---|---|---|
| 1,174,763 | 3/1916 | Redlon . |
| 1,931,066 | 10/1933 | Eckert . |
| 2,878,743 | 3/1959 | Trunnell . |
| 3,082,677 | 3/1963 | Pease . |
| 3,520,245 | 7/1970 | Painter . |
| 3,593,478 | 7/1971 | Mason . |
| 4,223,486 | 9/1980 | Kelly . |
| 4,372,585 | 2/1983 | Evora . |
| 4,524,262 | 6/1985 | Meyer . |
| 4,593,504 | 6/1986 | Bonnici et al. . |
| 4,622,887 | 11/1986 | Peterson . |
| 4,757,654 | 7/1988 | Korhonen et al. . |
| 4,768,812 | 9/1988 | Katz . |
| 4,965,971 | 10/1990 | Jean-Jacques et al. . |
| 5,094,049 | 3/1992 | Sells . |
| 5,237,789 | 8/1993 | Thaler . |
| 5,347,776 | 9/1994 | Skoff . |
| 5,472,241 | 12/1995 | Kosik, Jr. et al. . |

*Primary Examiner*—Harold Joyce
*Assistant Examiner*—Derek S. Boles
*Attorney, Agent, or Firm*—James Creighton Wray; Meera P. Narasimhan

[57] ABSTRACT

A roof vent for sheet material roofs and for seamed metal roofs slides along the roof as the roofing sheet expands and contracts. The vent includes a base having a radially extending base flange and a generally cylindrical body portion extending upward from the base flange. The body portion of the base extends through an air ventilation opening provided in the roofing sheet. A double-sided adhesive ring is positioned between the upper surface of the base flange and the undersurface of the roofing sheet surrounding the opening for securing the base flange to the roofing sheet against movement or turning. A gasket is placed around the body portion of the base and abuts the upper surface of the roofing sheet for providing a watertight seal. A main body with a lower flange is placed over and connected to the body portion of the base. The outer surface of the body portion of the base includes male threads that are received by female threads provided on the lower, inner surface of the main body for effecting a tight connection by compressing the gasket against the roofing as supported by the base flange. Lower edges of the main body are stepped for mating with the L-shaped gasket. Multiple standoffs and a flow directing wall extend from upper edges of the main body. A cap is removably connected to the main body of the vent. The cap includes a sloped crown and side walls-extending downward and outward from outer edges of the crown. Receivers extend from the inner surface of the top for receiving the standoffs and a flow directing wall of the main body. When assembled, the side walls and crown of the cap prevent elements from entering the main body while permitting free air flow.

24 Claims, 5 Drawing Sheets

ROOF VENT

BACKGROUND OF THE INVENTION

This invention relates to vents for seamed metal roofs that slide along roof surfaces as the roofing material expands and contracts.

Ventilation apparatus are provided on roofs for preventing condensation, which over time cause the wood and other building materials to rot. Existing ventilation apparatus, particularly when used in conjunction with metal roofs, have proven inadequate. One of the attributes of sheet metal roofs is that they are capable of moving on the underlying roof sheathing as the metal contracts or expands with temperature changes. That expansion and contraction, when unfettered, encourages roof longevity, as buckling and lifting are avoided. Existing vents are generally fixed pipes that protrude from roofs. Those pipes are sealed to the roofing sheets, which in turn are anchored to the rafters. That causes unsightly buckling and unintended movement of the roofing sheets upon the roof. Breaks in the roof develop, allowing different channels for the entry of water to damage the underlying sheathing and roof. Needs exist for vents that move with the metal roofing sheets.

Existing vents fail to provide watertight barriers. Attachment means, such as nails, penetrate the metal roofs and cause beaks in the security of the roof. Rain and snow may enter the open ends of the vents and cause undesirable water damage in the underlying roof. Needs exist for vents that allow for the free passage of air while hindering passage of external elements. Needs further exist for vents that are mounted on roofs without the need for connectors that penetrate roof surfaces.

SUMMARY OF THE INVENTION

The present invention is a vent for sheet material roofs and for standing seam metal roofs. The vent is connected to the roofing sheet by adhesive and clamping and moves with the roofing sheet as the sheet expands and contracts. A watertight seal is provided by a gasket and through the use of vent attachments which do not penetrate the roofing sheet. A cap is provided for preventing rain, snow and other elements from entering or blocking the vent.

The present vent include s a generally circular base, a connector for attaching the base to a roofing sheet, a gasket, a main body and a cap. The base has a laterally extending flange and a generally circular body portion extending upward from the flange. The body portion is generally cylindrical in shape. The body portion of the base extends through an air ventilation opening provided in the roofing sheet. The connector, which is preferably a double-sided adhesive ring, is positioned between the upper surface of the flange and the undersurface of the roofing sheet surrounding the opening through which the body portion of the base extends. The adhesive ring connects the base to the underside of the roofing sheet. The gasket is placed over the body portion of the base and abuts the upper surface of the roofing sheet around the opening for providing a watertight seal upon compression. The main body of the vent is placed over and connected to the body portion of the base. Preferably, the outer surface of the body portion of the base includes male threads that are received by female threads provided on the lower, inner surface of the main body for compressing the gasket and effecting a tight connection. A lower edge of the main body is stepped for mating with a step in the L-shaped gasket, thereby preventing migration or distortion of the gasket and forming a watertight seal. The downward pressure of the main body compresses the gasket, thereby sealing the opening in the roofing sheet. Multiple standoffs and a flow directing wall extend from upper edges of the main body. A cap is removably and mechanically connected to the main body of the vent. The cap includes a sloped top and side walls extending downward and outward from outer edges of the top. Receivers extend from the inner surface of the top for receiving the standoffs and the flow directing wall of the main body. The receivers are preferably pockets having short outside members, short side members and long inside members. The pockets frictionally engage, snap and lock the opposing standoffs and the connecting wall for securing the cap to the main body. When assembled, the side walls and top of the cap prevent elements from entering the main body while permitting free air flow through the vent.

Preferably, the present vent has a generally circular cross-section. An air passage is defined by the inner walls of the body portion of the base and the inner walls of the main body. Air exits and enters the vent through slots provided along the top edge of the main body between the adjacent standoffs and the connector wall. Specifically, air flows up the central air passage, out through the slots, and down the open ended chamber defined by the inner surface of the side walls of the cap and the outer surface of the main body, and exits into the atmosphere. The opposite path is travelled by incoming air. The side walls and top of the cap prevent rain, snow and other roof damaging elements from entering the air passage.

The flange of the base is connected to the underside of the roofing sheet by an adhesive. Preferably, the adhesive is in the form of a double-sided adhesive, reinforced foam ring made of material used to stick trim to automobiles. The upper surface of the flange slopes outward and gradually downward from the body portion of the base. Thus, the flange gradually decreases in thickness as it extends laterally from the body portion. That allows the roofing sheet to extend along and beyond the flange without an abrupt step.

The main body of the vent is mechanically connected to the body portion of the base. Preferably, the diameter of the body portion of the base is smaller than the diameter of the main body such that the walls of the main body surround the body portion of the base. A gasket is provided between bottom edges of the main body and the roofing sheet for preventing water from entering the opening in the roofing sheet and damaging the underlying roof. Preferably, bottom edges of the main body have surfaces which correspond to the shape of the gasket to effect a perfect seal.

The present vent is molded from any acceptable material. In preferred embodiments, the cap, main body and base are all made of a glass-filled polycarbonate.

A roof ventilation apparatus includes a base having a laterally extended base flange and a body portion extending upward from the flange. The base body portion extends through an opening in a roofing sheet. A connector connects the base to the roofing sheet. A lower end of a main body is connected to the base body portion. A gasket is provided around the base body portion and between the lower end of the main body and the roofing sheet. The gasket is compressed against the roofing sheet when the main body is connected to the base body portion of the base. A cap is connected to an upper end of the main body. The cap includes a top and side walls extending downward from the top and around the main body. Air passages are formed between the main body and the side walls of the cap.

The base flange preferably has a generally flat lower surface and an upper surface that slopes outward and downward from the body portion. The base flange and the base body portion preferably have generally circular cross-sections, as do the gasket and the main body.

The body portion of the base has an inner diameter and an outer diameter and the main body has an inner diameter and an outer diameter. Preferably, the outer diameter of the base body portion is smaller than the outer diameter of the main body, with the base body portion being received in the lower end of the main body.

In preferred embodiments, the base body portion has male threads extending along its outer surface. Female threads for engaging the male threads of the base body portion are positioned in an inner surface of the main body proximate the lower end of the main body.

The gasket of the present vent preferably has a thick inner portion and a thin outer portion. The lower end of the main body includes a flange having an indented inner portion and wide outer portion. The upward extended thick inner portion of the gasket rests along the indented inner portion of the main body flange when the main body is secured to the base body portion. The interengaging steps prevent the gasket from spreading or creeping under compression.

Spaced ribs extend from an outer surface of the main body proximate the lower end. The ribs are gripped by a spanner for assembling the main body and the base.

Preferably, the upper end of the main body includes spaced axial extensions. The cap includes complementary pockets for receiving the extensions and for connecting the cap to the main body. Each pocket preferably includes a pair of opposing side walls, a pair of opposing end walls and a receiving cavity defined by inner surfaces of the end walls and the side walls. One side wall of the pair of side walls preferably extends further than the opposing side wall. The extensions preferably include multiple standoffs and a flow directing wall. In those embodiments, the cap includes multiple small pockets for receiving the standoffs and a large pocket for receiving the flow directing wall. Preferably, the flow directing wall and the large pocket are curved. The pockets define receiving cavities. Dimensions of the receiving cavities are complementary to dimensions of the extensions for frictionally securing the extensions in the pockets. Bonding material may be added or the caps may be welded in the pockets with energy directors and high frequency welding in a preassembly of the main body and cap before installation. The long inner walls of the pocket frictionally engage the extensions and provide extended surfaces for bonding. Interlocking detents may be provided.

The cap of the present vent further includes a crown and walls extending downward from side edges of the crown. The crown slopes downward and outward from its center. The walls slope downward and outward from the side edges of the crown.

In preferred embodiments, the connector for initially connecting the base to the roofing sheet is an adhesive, such as a double-sided adhesive strip.

A method for installing a vent includes the step of providing an opening in a roofing sheet. A first side of a double-sided adhesive ring is pre-attached to an upper surface of the base flange. A release sheet is removed from a second side of the ring. The body portion of the base is extended through the opening in the roofing sheet. The undersurface of the roofing sheet around the opening is brought into contact with the second side of the adhesive sheet for connecting the base to the roofing sheet. A gasket is positioned around the body portion of the base. A main body is connected to the body portion of the base, compressing the gasket between a lower end of the main body and an upper surface of the roofing sheet for sealing the opening in the roofing sheet. A cap is secured over an upper end of the main body for preventing rain, snow and other elements from entering the vent.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
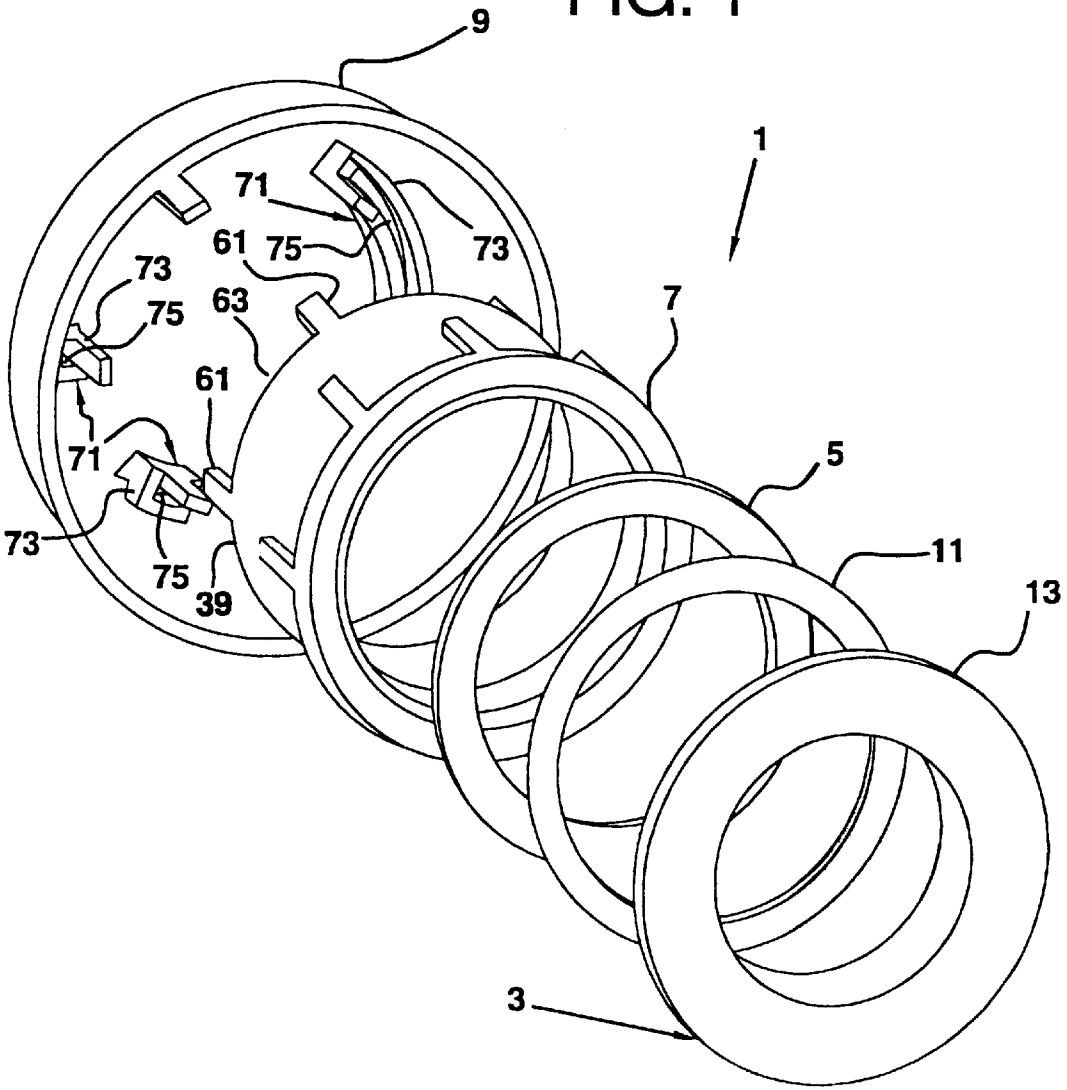
FIG. 1 is an exploded bottom perspective view of the new vent elements.
Figure 2:
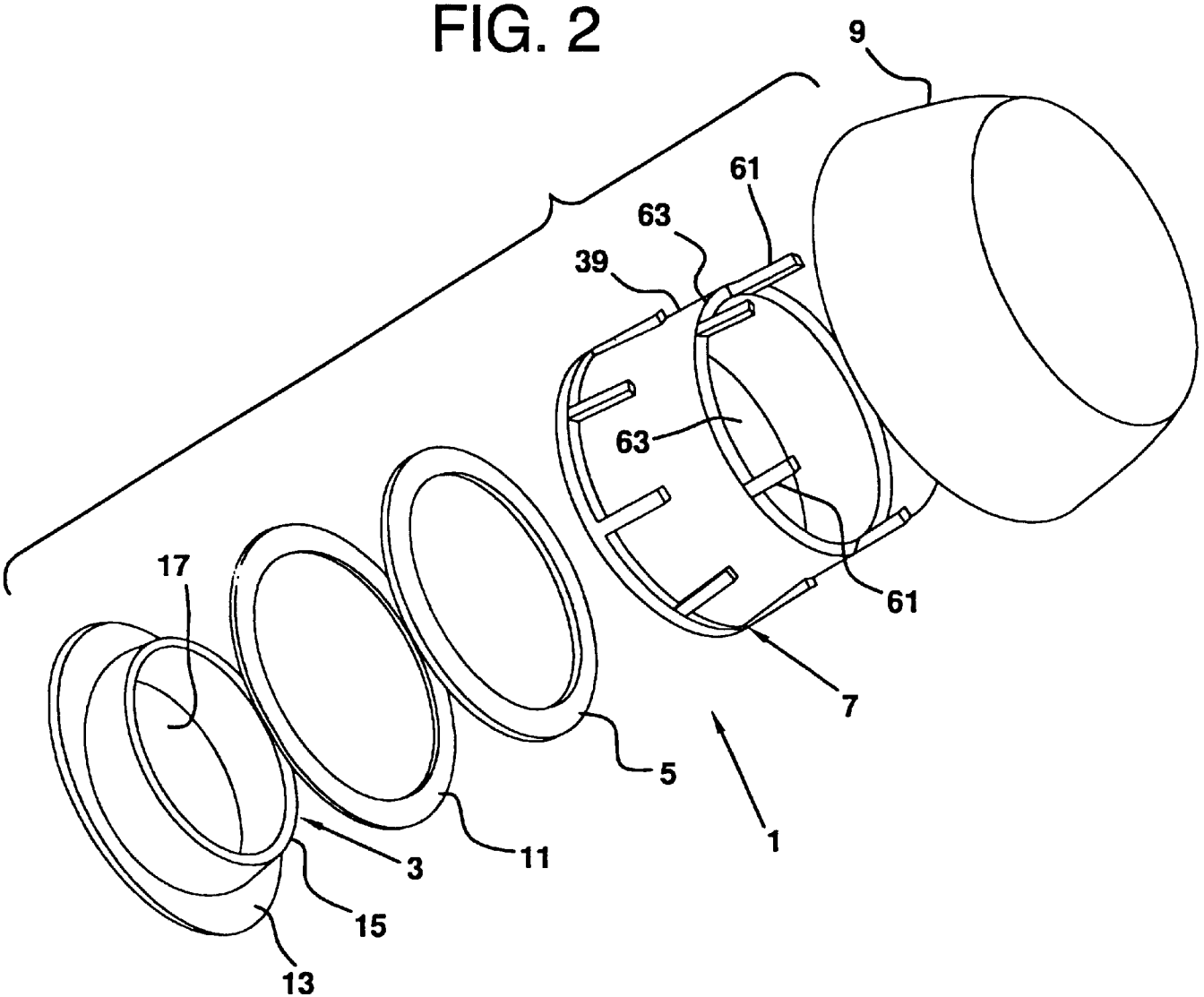
FIG. 2 is an exploded top perspective view of the vent elements shown in FIG. 1.

Referring to FIGS. 1 and 2, the present vent 1 includes a base 3, a gasket 5, a main body 7, a cap 9 and a connector 11 for connecting the vent to a roofing sheet. A venting hole is provided in the surface of the roof. A roofing sheet overlies the surface of the roof and has an opening cutout complementary to the venting hole for ventilation. The present vent 1 is affixed to the roofing sheet in communication with the venting hole such that the vent 1 moves with the roofing sheet as the roofing sheet expands and contracts in response to temperature changes. The present vent 1 is easily assembled and installed without the need for roof-piercing connectors, such as screws or nails.

The present vent 1 may take any size or shape. As shown in FIG. 1, the base 3, the gasket 5, the main body 7, the cap 9 and the connector 11 preferably have substantially circular cross-sections. In preferred embodiments, the base 3, the main body 7 and the cap 9 are made of glass-filled polycarbonate, and the gasket 5 is made of silicone. Other durable plastics or other materials may be used.

Figure 3:
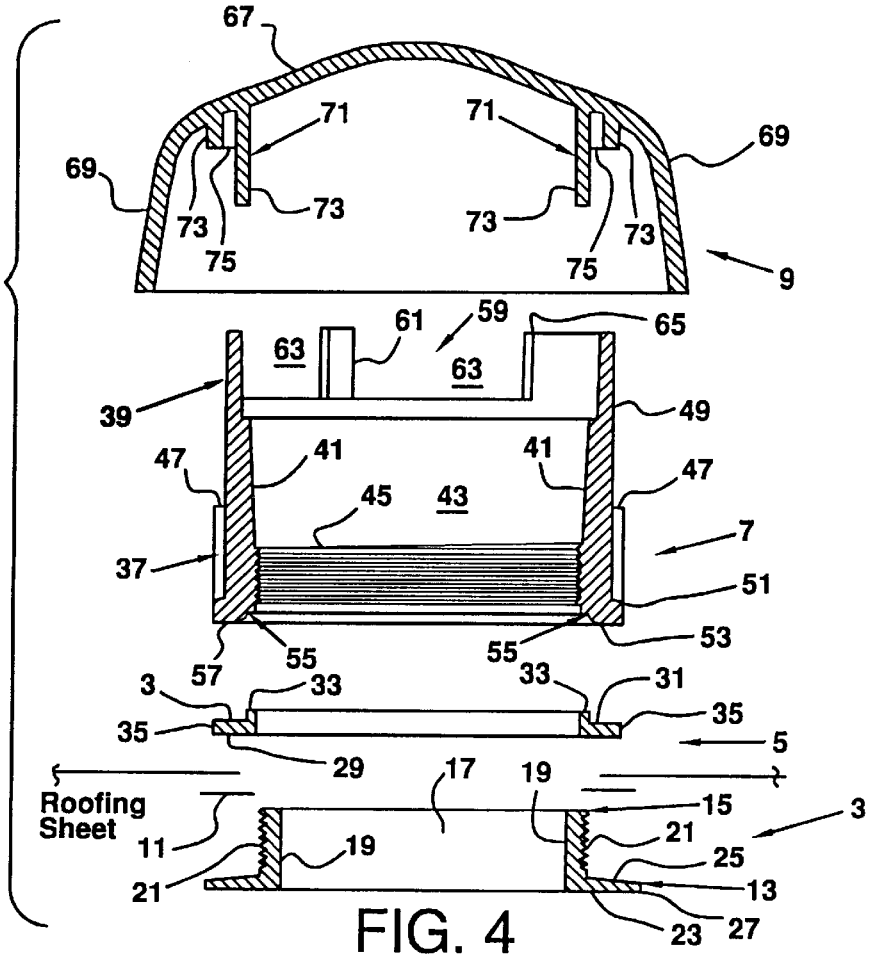
FIG. 3 is an exploded cross-sectional view of the new vent elements shown in FIGS. 1 and 2.

As shown in FIGS. 2 and 3, the present vent 1 includes a base 3 having a laterally extended flange 13 and a body portion 15 extending upward from the flange 13. An air passage 17 is defined by inner surfaces 19 of the body portion 15. The body portion 15 preferably has a mating surface 21 for connecting the body portion 15 to the main body 7. FIG. 3 shows a preferred embodiment of the present vent 1 wherein the mating surface 21 of the base body portion 15 includes male threads. Any acceptable attachment means may be used. For example, the body portion 15 may have an outer diameter slightly smaller than the inner diameter of the main body 7, such that the outer surface of the body portion 15 frictionally engages the inner surface of the main body 7 in an interference fit when the base body portion 15 receives the main body 7. In other embodiments, spring-biased projections or detents may be provided on the outer surface of the body portion 15 for engaging receivers or complementary detents in the inner surface of the main body 7. Preferably, the connection of the base body portion 15 to the main body 7 is substantially water and air tight.

Flange 13 extends from lower edges of the body portion 15 of the base 3. As shown in FIG. 3, in preferred embodiments the flange 13 has a substantially flat lower surface 23 and an upper surface 25 that slopes outward and downward from the base body portion 15. The sloped upper surface 25 allows the overlying roofing sheet to gradually, as opposed to abruptly, proceed over the outer edge 27 of the flange 13 and onto the roof. That prevents or reduces stress focusing in the roofing at the outer edge of the flange 13.

As shown in FIGS. 1 and 2, a connector 11 is included for connecting the upper surface 25 of the base flange 13 to the undersurface of the roofing sheet. That connector 11 is preferably a double-sided adhesive, reinforced foam strip. When the flange 13 has a circular shape, the strip 11 is preferably a double-sided adhesive ring having an inner diameter slightly greater than the outer diameter of the base body portion 15. The connector 11 is placed around the base body portion 15 and is adhered to the upper surface of the flange 13. A paper backing overlies the roof-contacting surface of the connector 11 prior to installation. For installing the vent 1, the base body portion 15 is extended through an opening in the roofing sheet. The backing is removed from the adhesive, and the undersurface of the roofing material surrounding the opening is pressed against the adhesive strip 11 adhered to the upper surface 25 of the flange 13, thereby securing the base 3 to the roofing sheet.

Figure 4:
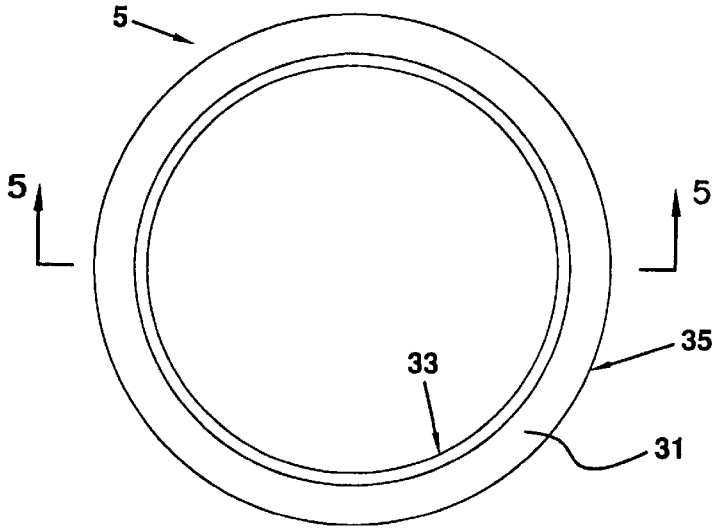
FIG. 4 is a plan view of the gasket of the present vent.
Figure 5:
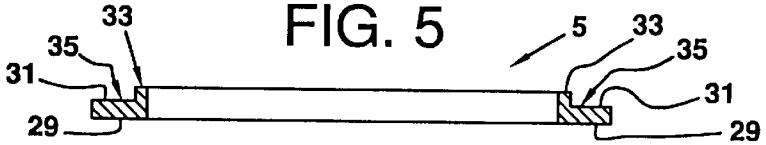
FIG. 5 is a cross-sectional elevation of the gasket taken along line A—A of FIG. 4.

As shown in FIGS. 3–5, a gasket 5 is positioned around the base body portion 15 for sealing the opening in the roofing sheet through which the body portion 15 extends. The gasket 5 preferably has a cross-sectional shape similar to the base body portion 15. As shown in FIGS. 4 and 5, the gasket 5 preferably has a generally flat bottom surface 29 and a stepped top surface 31. In preferred embodiments, the gasket 5 includes a tall, thin inner region 33 and a short, wide outer region 35. The gasket 5 has an inner diameter that is slightly larger than the outer diameter of the base body portion 15. Once the base 3 has been attached to the roofing sheet, the gasket 5 is positioned around the body portion 15, with the bottom surface 29 of the gasket 5 resting on the roofing sheet. Preferably, the inner region 33 of the gasket 5 extends beneath the mating surface 21 provided on the outer surface of the base body portion 15 so as not to block the mating surface 21.

Figure 6:
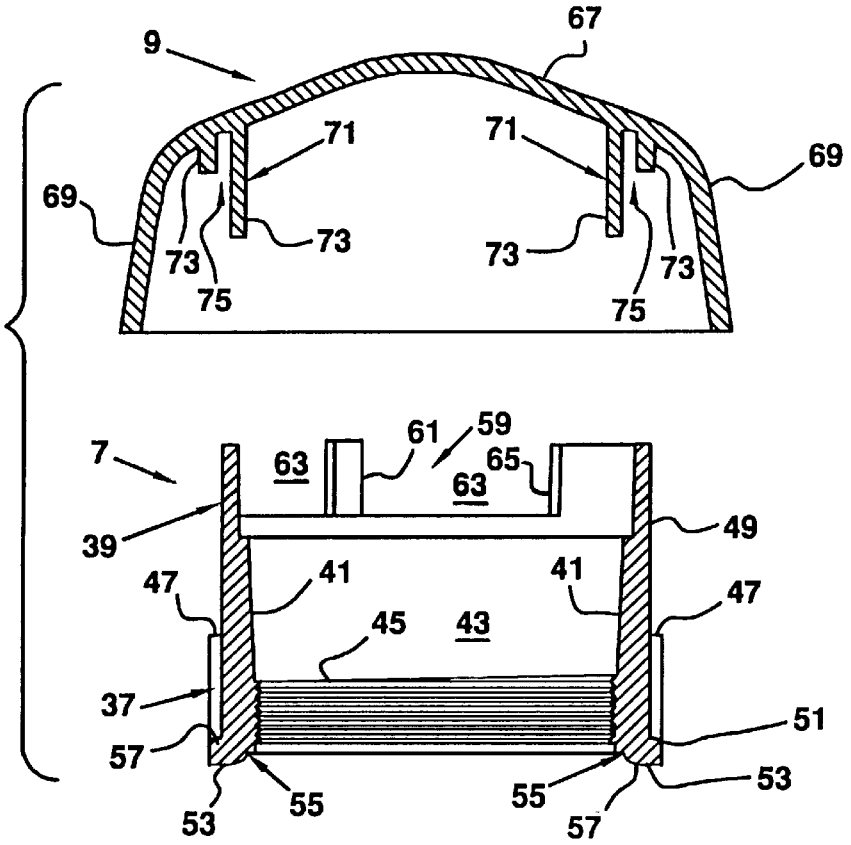
FIG. 6 is a cross-sectional elevation of the cap and main body before assembly.
Figure 7:
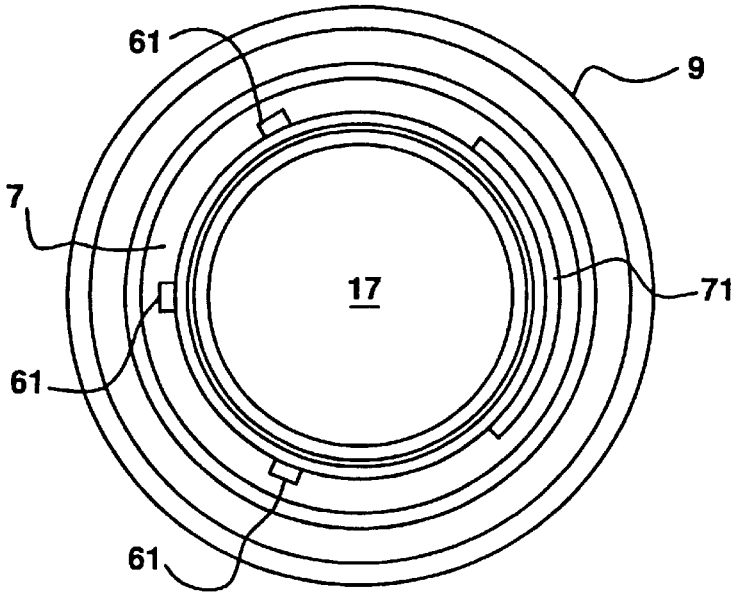
FIG. 7 is a bottom view of the main body and cap combination.

As best shown in FIGS. 3 and 6, the present vent 1 includes a main body 7 having a lower end 37 that is connectable to the base body portion 15 and an upper end 39 that is connectable to the cap 9. The main body 7 is preferably generally cylindrical and has an inner surface 41 that defines the air passage 43. Attachment means 45 are positioned near the lower end 37 of the main body 7 for connecting the main body 7 to the base body portion 15. As shown in FIGS. 3 and 6, the attachment means 45 preferably includes female threads provided along the inner surface 41 of the main body 7. Female threads of the main body 7 cooperate with the male threads of the base body portion 15 for tightly securing the main body 7 to the base 3. In preferred embodiments, vertical ribs 47 are provided along the outer surface 49 of the main body 7 near its lower end 37 for facilitating tightening of the main body 7 with a spanner wrench. Other acceptable attachment means 45 may be used.

As shown in FIGS. 3 and 6, a main body flange 51 extends from the lower end 37 of the main body 7. The main body flange 51 has a bottom surface 53 that is the reverse image of the upper surface 31 of the gasket 5. When the main body 7 is attached to the base 3, the main body flange 51 compresses the gasket 5 against the roofing sheet, thereby sealing the opening in the roofing sheet. The bottom surface 53 of the main body flange 51 perfectly matches the upper surface 31 of the gasket 5, forming a watertight seal. For the embodiments shown in FIGS. 3 and 6, the indented regions 55 of the main body flange 51 receive the tall, thin regions 33 of the gasket 5, to prevent slippage or migration of the gasket 5. The wide, substantially flat or slightly sloped regions 57 of the main body flange 51 abut the short, wide regions 35 of the gasket 5 and compress the gasket 5 in a watertight seal.

The upper end 39 of the main body 7 includes connectors 59 for connecting the main body 7 to the cap 9. As shown in FIGS. 1, 2, 3 and 6, the connectors 59 preferably include a ring of projections 61 extending upward from the upper end 39 of the main body 7. Preferably, the projections 61 are spaced apart such that air passages 63 are formed therebetween. The projections 61 may have any size and shape. Any number of projections 61 are also possible.

As shown in FIGS. 1, 2, 3 and 6, preferred embodiments of the present vent 1 include a main body 7 having multiple circumferentially short projections 61 and one circumferentially long projection 65. The long projection 65 is preferably a wall that follows the curvature of the main body 7. The wall 65 extends around less than half, and preferably closer to one third, of the perimeter of the main body 7. The short projections 61, which are preferably standoffs, extend from the upper end 39 of the main body 7 and are spaced from each other and from the wall 65. Air passages 63 are formed between the standoffs 61 and between the wall 65 and its adjacent standoffs 61. The wall 65 controls and directs the flow of air into and out of the vent 1 and prevents snow or ice from entering the up-roof side of the vent 1 as solids move downward along the roof.

FIGS. 3 and 6 show a preferred embodiment of the cap 9 for use in the present vent 1. The cap 9 includes a top 67 and walls 69 extending downward from the top 67. The top 67 of the cap 9 preferably slopes slightly downward from its center. The walls 69 preferably slope downward and outward from the top 67. Receivers 71 extend from the inner surface of the top 67 of the cap 9. Preferably, the receivers 71 are pockets having dimensions for frictionally receiving and holding the projections 61, 65 extending from the upper end 39 of the main body 7. As shown in FIGS. 1, 3 and 6, the pockets 71 are preferably formed from multiple walls 73 defining a cavity 75 therebetween. For the smaller pockets, the inner wall of the pocket preferably extends further than the other walls. Longer extensions may also be provided on the inner wall of the larger pocket. The projections 61, 65 of the main body 7 are preferably frictionally engaged or snap fitted by the receivers 71 of the cap 9. In alternative embodiments, projections may extend from the top of the cap, with receivers positioned along the upper end of the main body for receiving the projections. Any acceptable connectors for joining the cap 9 to the main body 7 are possible.

The walls 69 of the cap 9 extend around the upper end 39 of the main body 7.

Figure 8:
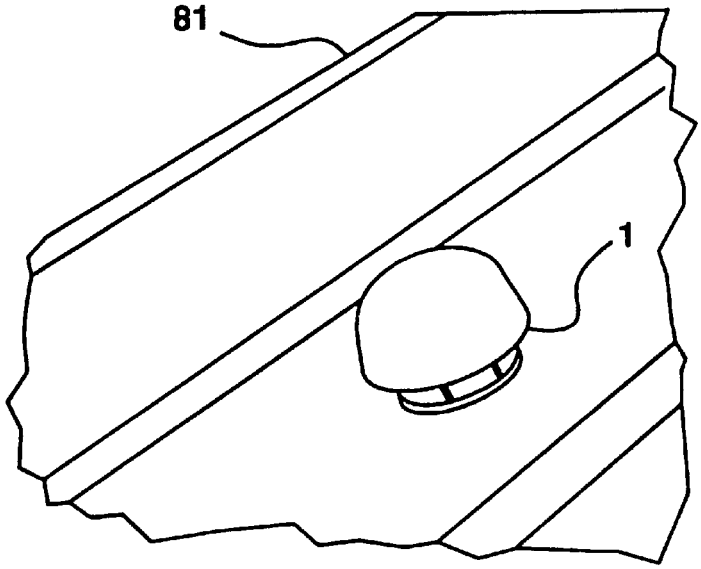
FIG. 8 shows the present vent installed on a metal roof.
Figure 9:
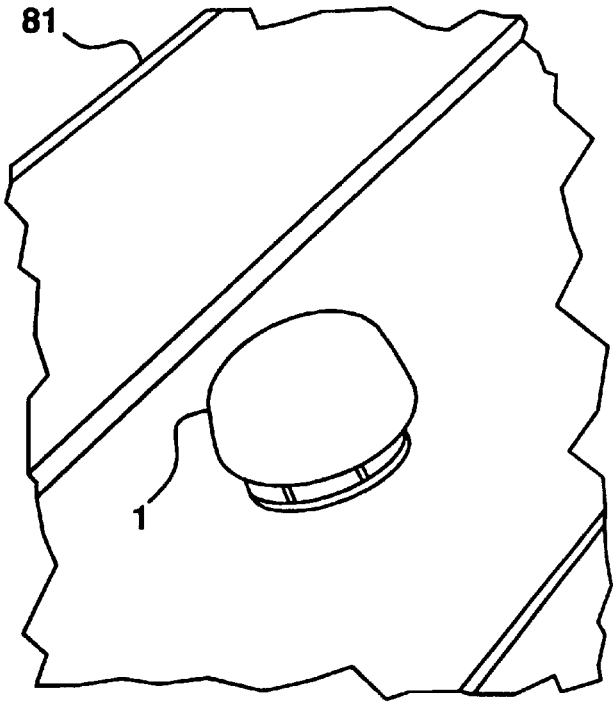
FIG. 9 shows a fully assembled vent installed on a metal roof.

FIGS. 8 and 9 show the present vent 1 installed on a roof 81. To install the present vent, a hole is first provided in the roof. That hole provides access to the attic, where condensation may be a problem. A corresponding opening is also provided in the roofing sheet that covers the roof. The double-sided adhesive ring or other connector is applied to the upper surface of the base flange. As the base body portion is extended up through the opening in the roofing sheet, the undersurface of the sheet surrounding the opening is pressed against the upper surface of the base flange and attached to the base flange by the adhesive. Once the base is attached to the roofing sheet, the gasket is positioned around the base body portion. The main body is then screwed onto the base body portion. As the main body is screwed tight, the flange on the lower end of the main body compresses the gasket against the upper surface of the roofing sheet and creates a watertight seal. The opening in the roofing sheet is completely sealed by the gasket and the flange of the main body. The cap is snap fitted onto the projections extending from the upper end of the main body. The top and side walls of the cap prevent snow, rain and other undesired elements from entering the air passage of the vent. As shown in FIG. 8, the side walls of the cap only partially surround the main body. The ribs provided on the outer surface of the main body are therefore easily accessible. Air travels from inside the attic, up through the hole in the roof, through the opening in the roofing sheet and into the air passage defined by the inner surfaces of the base body portion and the main body. Air continues to flow through spaces provided between the projections of the main body. The wall projection of the main body, along with the top and side walls of the cap, direct air flow down between the side walls of the cap and the outer surfaces of the main body and out of the vent. The reverse air flow is also possible.

While the invention has been described with reference to specific embodiments, modifications and variations of the invention may be constructed without departing from the scope of the invention, which is defined in the following claims.

I claim:

1. A roof ventilation apparatus comprising a base having a laterally extended base flange and a body portion extending upward from the flange, wherein the body portion extends through an opening in a roofing sheet, a connector for connecting the base to the roofing sheet, a main body having a lower end connected to the body portion of the base, a gasket provided around the body portion of the base and between the lower end of the main body and the roofing sheet for compressing against the roofing sheet when the main body is connected to the body portion of the base for preventing leakage around the opening in the roofing sheet, and a cap connected to an upper end of the main body, the cap having a top and side walls extending from the top around the main body, and wherein air passages are formed between the main body and the side walls of the cap.

2. The apparatus of claim 1, wherein the flange has a generally flat lower surface and an upper surface that slopes outward and downward from the body portion.

3. The apparatus of claim 1, wherein the flange and the body portion of the base are generally circular, wherein the gasket is generally circular and wherein the main body is generally circular.

4. The apparatus of claim 3, wherein the body portion of the base has an inner diameter and an outer diameter, wherein the main body has an inner diameter and an outer diameter, and wherein the outer diameter of the body portion of the base is smaller than the outer diameter of the main body, and wherein the body portion of the base is received in the lower end of the main body.

5. The apparatus of claim 3, wherein the body portion has male threads extending along an outer surface of the body portion, and wherein female threads for engaging the male threads of the body portion are positioned in an inner surface of the main body proximate the lower end of the main body.

6. The apparatus of claim 1, wherein the gasket has a thick inner portion and a thin outer portion, and wherein the lower end of the main body further comprises a main body flange having an indented inner portion and wide outer portion, and wherein the thick inner portion of the gasket rests along the indented inner portion of the main body flange when the main body is secured to the body portion of the base.

7. The apparatus of claim 6, wherein the flange extends beyond side walls of the main body.

8. The apparatus of claim 1, further comprising spaced ribs extending from an outer surface of the main body proximate the lower end, wherein the ribs are engagable for assembling or separating the main body and the body portion of the base.

9. The apparatus of claim 1, wherein the upper end of the main body further comprises spaced extensions, and wherein the cap further comprises pockets for receiving the extensions and for connecting the cap to the main body.

10. The apparatus of claim 9, wherein the each pocket further comprises a pair of opposing side walls, a pair of opposing end walls and a receiving cavity defined by inner surfaces of the end walls and the side walls.

11. The apparatus of claim 10, wherein one side wall of the pair of side walls extends further than the opposing side wall.

12. The apparatus of claim 9, wherein the extensions further comprise multiple standoffs and a flow directing wall, and wherein the pockets further comprise multiple small pockets for receiving the standoffs and a large pocket for receiving the flow directing wall.

13. The apparatus of claim 12, wherein the flow directing wall is curved, and wherein the large pocket is curved.

14. The apparatus of claim 9, wherein the pockets define receiving cavities, and wherein dimensions of the receiving cavities are slightly greater than dimensions of the extensions for frictionally securing the extensions in the pockets.

15. The apparatus of claim 1, wherein the cap further comprises a top and walls extending downward from side edges of the top.

16. The apparatus of claim 15, where the top slopes downward from a center, and wherein the walls slope downward and outward from the side edges of the top.

17. The apparatus of claim 1, wherein the connector for connecting the base to the roofing sheet is an adhesive.

18. The apparatus of claim 17, wherein the connector is a double-sided adhesive strip.

19. A method for installing a vent comprising providing an opening in a roofing sheet, providing a base having a laterally extended base flange and a body portion extending upward from the flange, attaching a first side of a double-sided adhesive sheet to an upper surface of the flange, inserting the body portion of the base through the opening in the roofing sheet, placing an undersurface of the roofing sheet around the opening in contact with a second side of the adhesive sheet for connecting the base to the roofing sheet, positioning a gasket around the body portion of the base, connecting a main body to the body portion of the base, compressing the gasket between a lower end of the main body and an upper surface of the roofing sheet for sealing the opening in the roofing sheet, and positioning a cap over an upper end of the main body.

20. A vent apparatus for sheet metal roofs comprising a base having a laterally extended base flange and a body portion extending upward from the flange, wherein the body portion extends through an opening in a roofing sheet and has male threads positioned along an outer surface, and wherein the flange has a generally flat bottom surface and an upper surface that slopes outward and downward from the body portion, a double-sided adhesive strip positioned on the upper surface of the flange for connecting the base to the roofing sheet, a main body having a lower end connected to the body portion of the base, a rim extending along the lower end, female threads positioned along an inner surface of the main body near the lower end, spaced standoffs extending from an upper end of the main body, a flow directing wall extending from the upper end of the main body, and flow passages defined by regions between standoffs and the flow directing wall, a gasket provided around the body portion of the base and between the lower end of the main body and the roofing sheet for compressing against the roofing sheet when the main body is connected to the body portion of the base for preventing leakage around the opening in the roofing sheet, and a cap connected to an upper end of the main body, the cap having a sloped top, side walls extending downward and outward from edges of the top, small pockets extending from an inner surface of the top for receiving the standoffs of the main body, and a large pocket extending from the inner surface of the top for receiving the flow direction wall of the main body, and wherein air passages are formed between the main body and the side walls of the cap.

21. A roof vent kit comprising a base having a base flange for underlying a roofing and a base body for extending through an opening, a gasket for surrounding the base body on top of the roofing and extending outward over the roofing around the opening, a main body having a lower main body flange, complementary connectors on the base body and the main body for holding the bodies in predetermined positions with the main body flange compressing the gasket against the roofing as supported by the base flange, and a cover on a top of the main body for preventing ingress of rain or snow.

22. The roof vent kit of claim 21, further comprising roofing extending outward from the opening for covering a roof.

23. The roof vent kit of claim 21, further comprising a double-sided adhesive foam ring connected between the base flange and an underside of the roofing for holding the base flange against the roofing and for preventing turning of the base flange with respect to the roofing during joining of the connectors and the compressing of the gasket.

24. The roof vent kit of claim 21, wherein the cover comprises a cap attached to an upper end of the main body, the cap having a sloping crown extending outward from the main body and a sloping side wall extending downward and outward from the crown, spaced outward from the main body for preventing ingress of water, snow and ice.

* * * * *